US011264195B2

(12) United States Patent
Kim et al.

(10) Patent No.: US 11,264,195 B2
(45) Date of Patent: Mar. 1, 2022

(54) RELAY

(71) Applicants: HYUNDAI MOTOR COMPANY, Seoul (KR); KIA MOTORS CORPORATION, Seoul (KR)

(72) Inventors: In Sic Kim, Incheon (KR); Jong Joo Kim, Suwon-si (KR); Sumi Son, Suwon-si (KR); Jae Yoon Lim, Bucheon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/922,130

(22) Filed: Jul. 7, 2020

(65) Prior Publication Data

US 2021/0050168 A1 Feb. 18, 2021

(30) Foreign Application Priority Data

Aug. 14, 2019 (KR) ..... 10-2019-0099472

(51) Int. Cl.

| | |
|---|---|
| ***H01H 50/30*** | (2006.01) |
| ***H01H 50/44*** | (2006.01) |
| ***H01H 50/14*** | (2006.01) |
| ***H01H 50/02*** | (2006.01) |

(52) U.S. Cl.

CPC ..... *H01H 50/305* (2013.01); *H01H 50/02* (2013.01); *H01H 50/14* (2013.01); *H01H 50/443* (2013.01)

(58) Field of Classification Search

CPC .... H01H 50/305; H01H 50/443; H01H 50/14; H01H 50/02; H01H 50/043; H01H 1/5805; H01H 50/041; H01H 50/36; H01H 50/18

See application file for complete search history.

(56) References Cited

U.S. PATENT DOCUMENTS

| | | | | |
|---|---|---|---|---|
| 3,024,439 A * | 3/1962 | Nielsen | ..... | H01H 50/14 439/712 |
| 4,812,794 A * | 3/1989 | Asbell | ..... | H01H 50/14 335/151 |
| 5,117,209 A * | 5/1992 | Sato | ..... | H01H 50/58 335/80 |

(Continued)

FOREIGN PATENT DOCUMENTS

| | | | | |
|---|---|---|---|---|
| DE | 3150125 A1 * | 7/1983 | ..... | H01H 49/00 |
| GB | 1338284 A * | 11/1973 | ..... | H01H 1/26 |
| JP | 10178286 A * | 6/1998 | ..... | H01H 50/14 |

OTHER PUBLICATIONS

Ip.com Search Results.*

*Primary Examiner* — Mohamad A Musleh

(74) *Attorney, Agent, or Firm* — McDonnell Boehnen Hulbert & Berghoff LLP

(57) ABSTRACT

The relay according to an embodiment of the disclosure includes a main body configured to open and close a circuit by an input signal, and a plurality of terminals extending from the main body and coupled to a PCB, wherein each of the plurality of terminals comprises an inclined extension portion configured to allow the main body to be spaced apart from the PCB and maintain an inclined state with respect to a surface of the PCB and a lower surface of the main body, and a coupling portion extending from the inclined extension portion in a direction to enter a coupling slot of the PCB.

7 Claims, 6 Drawing Sheets

(56) References Cited

U.S. PATENT DOCUMENTS

| | | | | |
|---|---|---|---|---|
| 5,673,012 | A * | 9/1997 | Stadler | H01H 50/026<br>335/128 |
| 6,194,656 | B1 * | 2/2001 | Kondo | H01H 50/14<br>174/251 |
| 2005/0040920 | A1 * | 2/2005 | Takano | H01H 50/026<br>335/128 |
| 2008/0030288 | A1 * | 2/2008 | Mader | H01H 50/043<br>335/2 |
| 2011/0139504 | A1 * | 6/2011 | Ambo | H05K 7/20854<br>174/84 C |

* cited by examiner

RELAY

CROSS REFERENCE TO RELATED APPLICATION(S)

This application is based on and claims priority under 35 U.S.C. § 119 to Korean Patent Application No. 10-2019-0099472, filed on Aug. 14, 2019, in the Korean Intellectual Property Office, the disclosure of which is incorporated by reference herein in its entirety.

BACKGROUND

1. Field

The disclosure relates to a relay capable of minimizing the transmission of noise and vibration caused by operations to the surroundings.

2. Description of Related Art

Relays, which are devices to open and close various circuits by operating in response to input signals, are widely used in vehicles and various industrial facilities.

Typical relays include a pole core magnetized by electric current, an armature operated by a magnetic force of the pole core, and a movable contact coming into contact with the fixed contact or being spaced from a fixed contact by moving by the operation of the armature. The movable contact is connected to the fixed contact as the armature is attached to the pole core by magnetization of the pole core, and the movable contact is separated from the fixed contact as the armature is spaced apart from the pole core by the release of the magnetization of the pole core.

The relay is typically installed in such a way that a plurality of terminals is coupled to a circuit of a printed circuit board (PCB) in a state in which a main body of the relay is in close contact with the PCB.

However, the relay may generate noise and vibration due to collisions occurring when the armature and movable contact operate, and the noise and vibration may be amplified as they transmit to peripheral components through the main body and the PCB.

SUMMARY

It is an aspect of the disclosure to provide a relay capable of minimizing the transmission of noise and vibration to the surroundings by mitigating the noise and vibration caused by operations Additional aspects of the disclosure will be set forth in part in the description which follows and, in part, will be obvious from the description, or may be learned by practice of the disclosure.

In accordance with an aspect of the disclosure, a relay includes a main body configured to open and close a circuit by an input signal; and a plurality of terminals extending from the main body and coupled to a PCB, wherein each of the plurality of terminals includes: an inclined extension portion configured to allow the main body to be spaced apart from the PCB and to maintain an inclined state with respect to a surface of the PCB and a lower surface of the main body; and a coupling portion extending from the inclined extension portion in a direction to enter a coupling slot of the PCB.

The relay may further include a base member coupled to the coupling portion of the plurality of terminals in a state of being spaced apart from the main body and installed in close contact with the surface of the PCB.

The plurality of terminals may be configured such that a width of the inclined extension portion is wider than a width of the coupling portion and the coupling portion passes through the base member to be coupled to the coupling slot of the PCB.

The plurality of terminals may include a step portion formed at a boundary between the inclined extension portion and the coupling portion and caught on a surface of the base member in a state in which the coupling portion is coupled to the base member.

The plurality of terminals may be configured such that the inclined extension portions are different from each other in length and inclination.

The plurality of terminals may be configured such that bent portions between the inclined extension portions and the coupling portions are different from each other in position.

The main body may include an opening-and-closing driving unit including a pole core on which a coil is wound, a yoke configured to support the pole core, an armature configured to operatively supported on the yoke and to be attached to or spaced from the pole core, and a movable contact configured to be operated by the armature; a fixed unit including a support plate configured to support the opening-and-closing driving unit, a contact support portion provided on one side of the support plate, and a fixed unit installed to the contact support portion such that the movable contact is in contact therewith or spaced apart therefrom; and a cover member configured to cover outer sides of the opening-and-closing driving unit and the fixed unit.

The yoke may be fixed to an upper surface of the support plate, the plurality of terminals may extend toward the PCB through an outer side of the support plate in a state in which a portion thereof is connected to the opening-and-closing driving unit and the rest is connected to the fixed unit, and a distance between the coupling portions of the plurality of terminals may be smaller than a width of the support plate.

Additional features and advantages are described herein, and will be apparent from, the following Detailed Description and the figures.

BRIEF DESCRIPTION OF THE FIGURES

These and/or other aspects of the disclosure will become apparent and more readily appreciated from the following description of the embodiments, taken in conjunction with the accompanying drawings of which.

DETAILED DESCRIPTION

Hereinafter embodiments of the disclosure will be described in detail with reference to the accompanying drawings. The embodiments described below are provided by way of example so that those skilled in the art will be able to fully understand the spirit of the disclosure. The disclosure is not limited to the embodiments described below, but may be embodied in other forms. In order to clearly explain the disclosure, parts not related to the description are omitted from the drawings, and the width, length, thickness, etc. of the components may be exaggerated for convenience.

Figure 1:
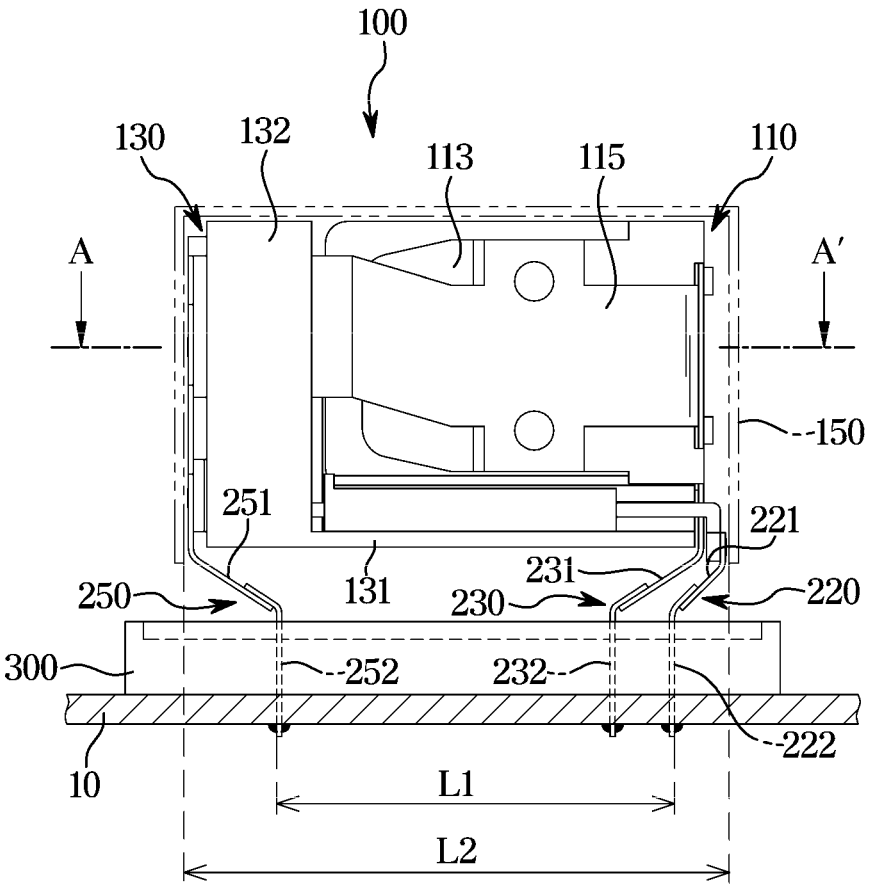
FIG. 1 is a side view illustrating a state in which a relay according to an embodiment of the disclosure is mounted on a PCB.
Figure 2:
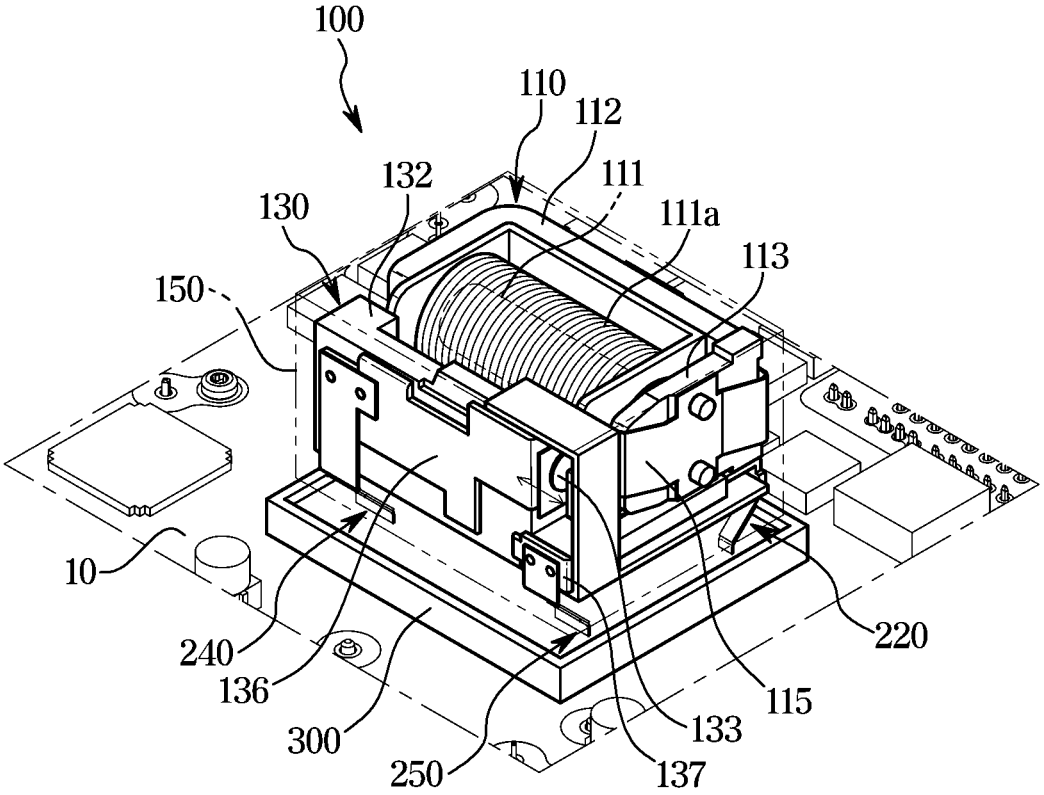
FIG. 2 is a perspective view illustrating a state in which the relay according to an embodiment of the disclosure is mounted on the PCB.
Figure 3:
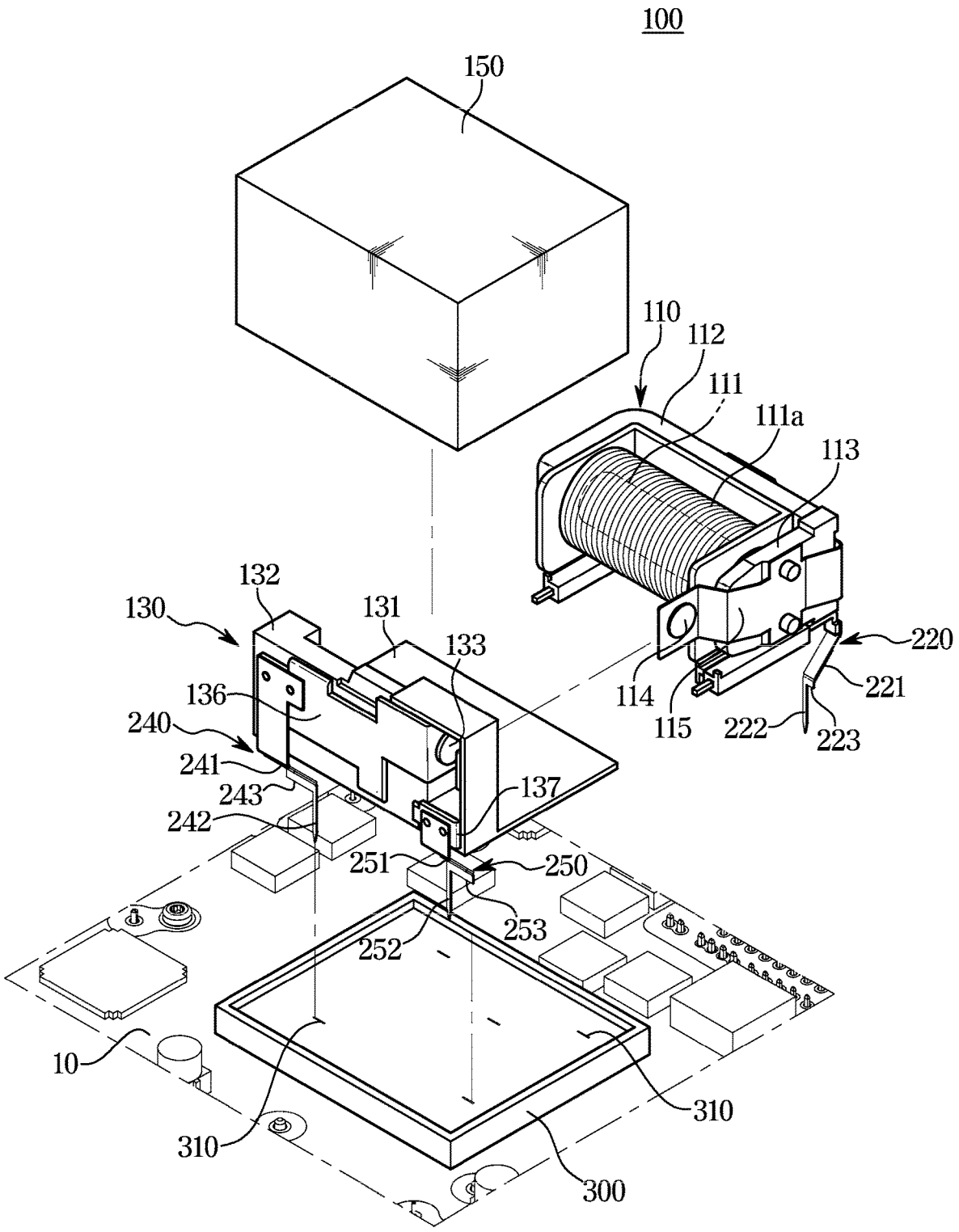
FIG. 3 is a perspective view illustrating a state in which an opening-and-closing driving unit and a fixed unit of the relay according to the disclosure are separated from each other.

Referring to FIGS. 1 to 3, a relay according to an embodiment of the disclosure includes a main body 100 configured to open and close a circuit by an input signal, a plurality of terminals 210, 220, 230, 240, and 250 coupled to the main body 100, and a base member 300 installed on a lower portion of the main body 100.

The main body 100 of the relay may include an opening-and-closing driving unit 110, a fixed unit 130, and a cover member 150.

The opening-and-closing driving unit 110 includes a pole core 111 having a coil 111*a* wound around an outer surface thereof, a yoke 112 configured to support the pole core 111, an armature 113 configured to operatively supported on one end of the yoke 112 and to be attached to or spaced from the pole core 111, and a movable contact 114 configured to be operated by the armature 113.

The pole core 111 extends in a direction parallel to a surface of the PCB 10 and one end thereof is fixed to the yoke 112. The yoke 112 may include a first support portion 112*a* to which one end of the pole core 111 is fixed, a second support portion 112*b* bent from one end of the first support portion 112*a* and extending in a longitudinal direction of the pole core 111, and a core support member 112*c* supporting opposite ends of the pole core 111 in a state of being fixed to an inner surface of the second support portion 112*b*. The coil 111*a* of the pole core 111 is connected to two of the terminals 210 and 220 installed on lower portions of opposite sides of the yoke 112. The pole core 111 may be magnetized when an electrical signal is applied through two of the terminals 210 and 220.

Figure 4:
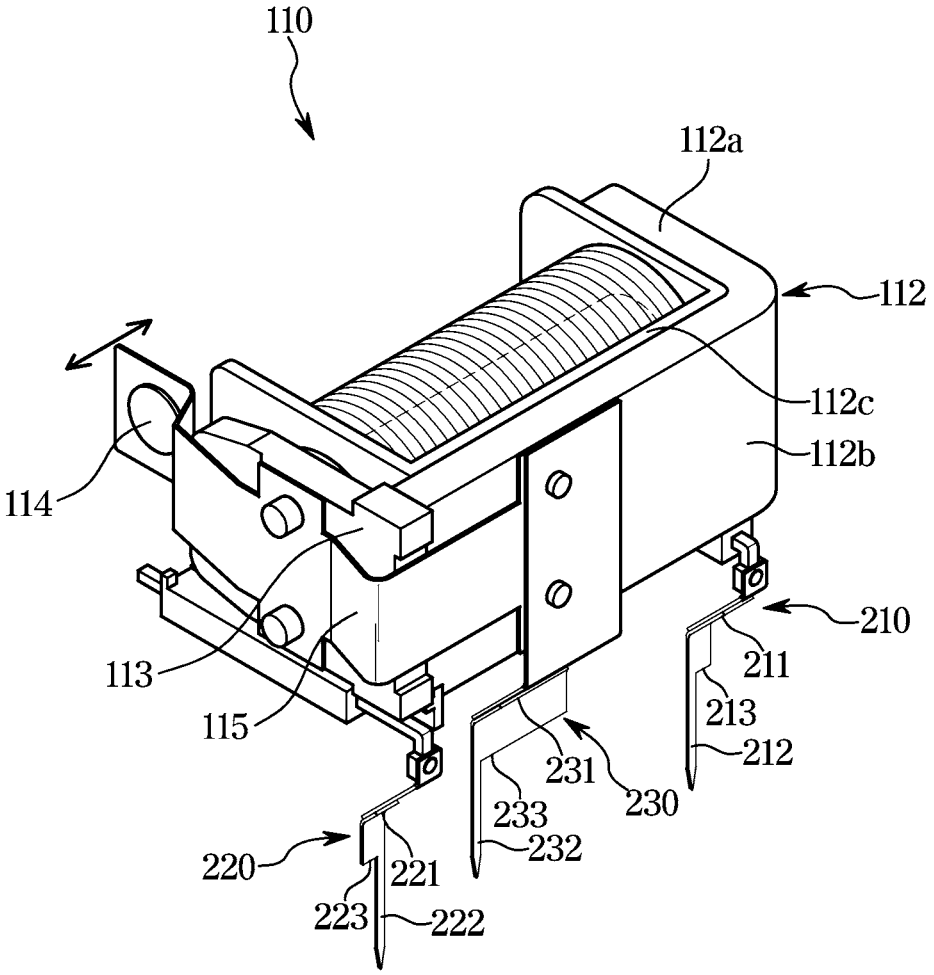
FIG. 4 is a perspective view of the opening-and-closing driving unit of the relay according to an embodiment of the disclosure viewed from a different angle.
Figure 5:
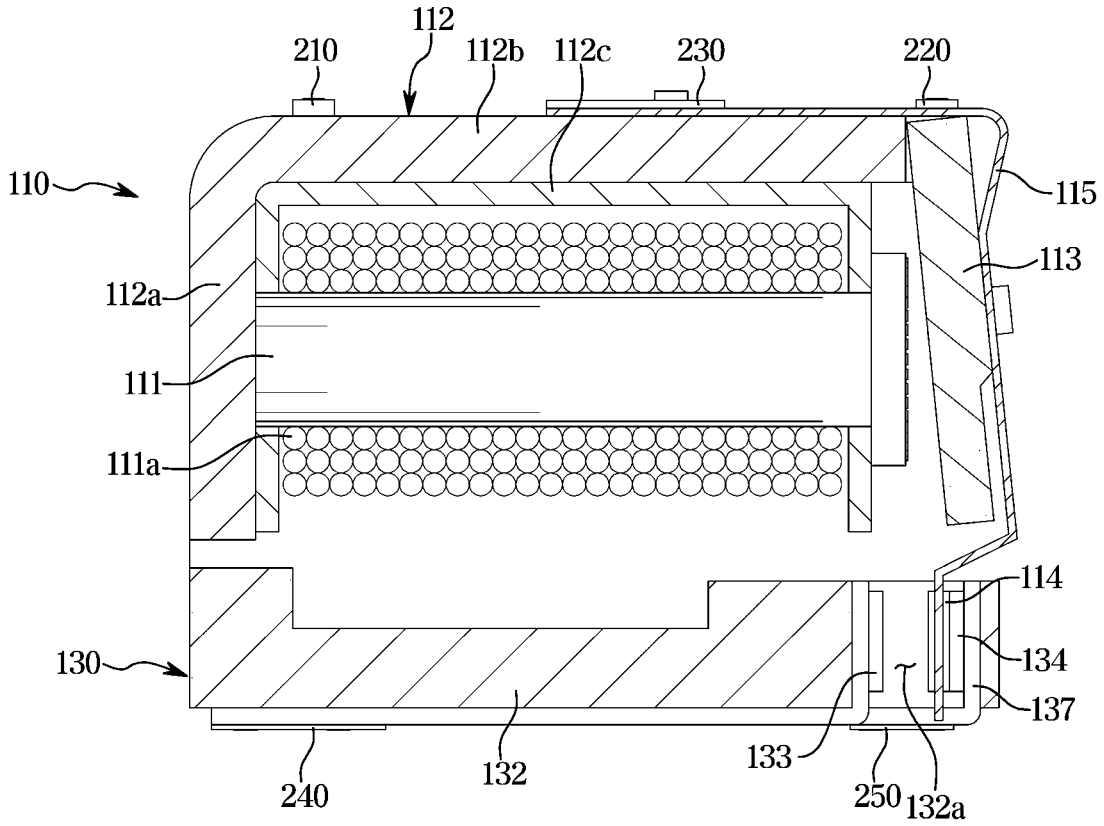
FIG. 5 is a cross-sectional view taken along line A-A' in FIG. 1, illustrating a state in which an armature is spaced apart from a pole core.

As illustrated in FIGS. 4 and 5, the armature 113 is provided in the form of a flat plate, and one side of the armature 113 is disposed adjacent to the end of the pole core 111 to face the first support portion 112*a* of the yoke 112. The other side of the armature 113 is movably supported by the second support portion 112*b* of the yoke 112 and connected to the second support portion 112*b* of the yoke 112 by an elastic leaf spring 115 for conduction.

The leaf spring 115 is bent and extends from an outer side surface of the second support portion 112*b* of the yoke 112 toward an outer surface of the armature 113 and extends longer than a length of the armature 113 in a free end direction of the armature 113. One side of the leaf spring 115 is fixed to the second support portion 112*b* of the yoke 112 and the other side thereof is fixed to the outer surface of the armature 113. Therefore, the armature 113 may be moved toward the pole core 111 by a magnetic force to be attached to the pole core 111 when the pole core 111 is magnetized, and may be moved back by the elasticity of the leaf spring 115 to be separated from the pole core 111 when the magnetization of the pole core 111 is released.

The movable contact 114 is installed on one end of the leaf spring 115 extending longer outside the free end of the armature 113 to be movable together with the armature 113. As illustrated in FIG. 4, a terminal 230 for conducting current of a load is connected to the leaf spring 115 coupled to an outer surface of the yoke 112.

Referring to FIGS. 3 and 5, the fixed unit 130 includes a support plate 131 configured to support the lower portion of the opening-and-closing driving unit 110, a contact support portion 132 provided in a block shape on one side of the support plate 131, and a first fixed contact 133 and a second fixed contact 134 installed to the contact support portion 132 and disposed with the movable contact 114 interposed therebetween such that the movable contact 114 may be in contact therewith or spaced apart therefrom. This embodiment illustrates a case where two fixed contacts are provided, but one fixed contact may be provided.

The support plate 131 and the contact support portion 132 may be integrally provided by an insulating material, and the contact support portion 132 may be vertically disposed on one side of the support plate 131. The contact support portion 132 has an entry space 132*a* into which the movable contact 114 of the opening-and-closing driving unit 110 enters, and the first and second fixed contacts 133 and 134 are installed on opposite sides of the entry space 132*a* to face each other. The opening-and-closing driving unit 110 is coupled to an upper surface of the support plate 131, and in this state, the movable contact 114 is maintained in a state of entering the entry space 132*a* between the first and second fixed contacts 133 and 134.

The terminals 240 and 250 are provided at opposite sides of the contact support portion 132 and connected to the first fixed contact 133 and the second fixed contact 134 by metal plates 137 for conduction, respectively.

Figure 6:
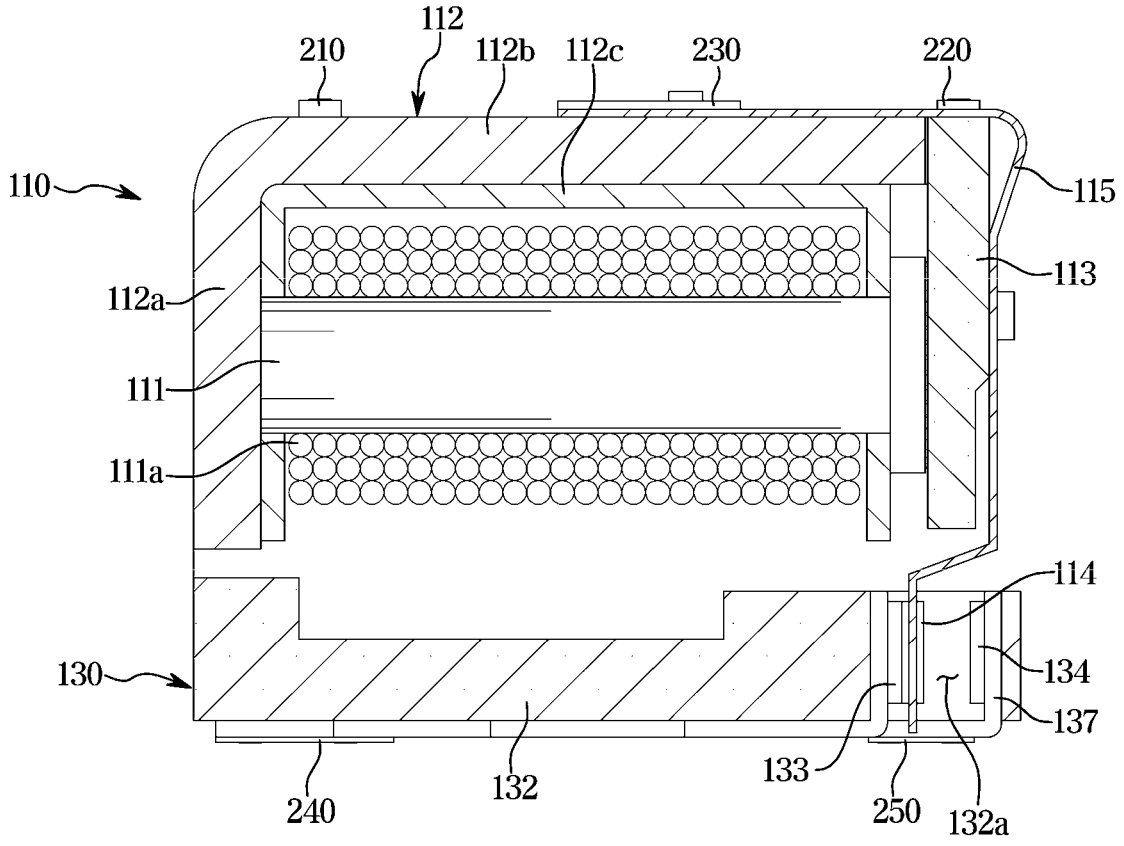
FIG. 6 is a cross-sectional view taken along the line A-A' in FIG. 1, illustrating a state in which the armature is attached to the pole core.

As illustrated in FIG. 5, in an initial state of the relay, the armature 113 may be maintained in a state of being spaced apart from the pole core 111, and the movable contact 114 may be maintained in a state of being in contact with the second fixed contact 134. As illustrated in FIG. 6, when an electric signal is applied to the pole core 111 and the pole core 111 is magnetized, the armature 113 may be attached to the pole core 111 by the magnetic force, and the movable contact 114 may be in contact with the first fixed contact 133. As such, the movable contact 114 is operated to come into contact with the first fixed contact 113 or the second fixed contact 134 by the operation of the opening-and-closing driving unit 110, so that the relay may allow a power source to selectively connect or disconnect.

As illustrated in FIGS. 1 to 3, the cover member 150 is provided in the form of a rectangular box with an open lower portion. The cover member 150 is installed on an outer side of the opening-and-closing driving unit 110 and the fixed unit 130 in a state in which the opening-and-closing driving unit 110 and the fixed unit 130 are assembled with each other. The cover member 150 may reduce collision noise caused by the operation of the opening-and-closing driving unit 110 and may protect the opening-and-closing driving unit 110 and the fixed unit 130 from foreign substances.

As illustrated in FIGS. 1, 3, and 4, the plurality of terminals 210, 220, 230, 240, and 250 extends downward from the main body 100 to be coupled to the PCB 10. The plurality of terminals 210, 220, 230, 240, and 250 includes inclined extension portion 211, 221, 231, 241, and 251 allowing the main body 100 to be spaced apart from the PCB 10 and maintaining an inclination with respect to the surface of the PCB 10 and a lower surface of the main body 100, and coupling portions 212, 222, 232, 242 and 252 extending in a direction of entering coupling slots of the PCB 10 from the inclined extension portions 211, 221, 231, 241 and 251, respectively.

The plurality of terminals 210, 220, 230, 240, and 250 extends toward the PCB 10 through an outer side of the support plate 131 in a state in which a portion thereof is connected to the opening-and-closing driving unit 110 of the main body 100 and the rest is connected to the fixed unit 130. In this case, as illustrated in FIG. 1, each of the inclined extension portions 211, 221, 231, 241, 251 extends closer to each other as it approaches the PCB 10, and each of the coupling portions 212, 222, 232, 242, and 252 extends parallel to each other in a direction perpendicular to the surface of the PCB 10 from a lower end of each of the inclined extension portions 211, 221, 231, 241, and 251. Therefore, a distance L1 between the coupling portions 212, 222, 232, 242 and 252 is shorter than a width L2 of the support plate 131.

The base member 300 may be provided in the form of a square flat plate by an insulating material. The base member 300 is coupled to the coupling portions 212, 222, 232, 242, and 252 of the plurality of terminals 210, 220, 230, 240, and 250 in a state of being spaced apart from the lower surface of the main body 100, and installed such that a lower surface thereof is in close contact with the surface of the PCB 10. As illustrated in FIG. 3, the base member 300 includes a plurality of coupling holes 310, through which the coupling portions 212, 222, 232, 242, and 252 pass, formed at positions corresponding to the coupling portions 212, 222, 232, 242, and 252 of the terminals 210, 220, 230, 240, and 250.

Widths of the inclined extension portions 211, 221, 231, 241, and 251 of the terminals 210, 220, 230, 240, and 250 may be wider than widths of the coupling portions 212, 222, 232, 242, and 252 of the terminals 210, 220, 230, 240, and 250, and the coupling portions 212, 222, 232, 242, and 252 may pass through the base member 300 to be coupled to the coupling slots of the PCB 10. The terminals 210, 220, 230, 240, and 250 include step portions 213, 223, 233, 243, and 253 formed at boundaries between the inclined extension portions 211, 221, 231, 241 and 251 and the coupling portions 212, 222, 232, 242 and 252, respectively, to be stably support on an upper surface of the base member 300. The step portions 213, 223, 233, 243, and 253 are caught to and supported on the surface of the base member 300 in a state in which the coupling portions 212, 222, 232, 242 and 252 are coupled to the base member 300, so that the main body 100 is stably supported on the base member 300 in a state of being spaced apart from the base member 300.

As such, the relay according to the present embodiment may minimize transmission of noise and vibration generated during operation to the surroundings by mitigating the noise and vibration with a cushioning function of the inclined extension portions 211, 221, 231, 241 and 251 because the inclined extension portions 211, 221, 231, 241, and 251 included in the terminals 210, 220, 230, 240, and 250 extend on an incline from the main body 100 to space the main body 100 apart from the PCB 10. An operation noise of the relay may be reduced because the elastically inclined extension portions 211, 221, 231, 241, and 251 attenuate the noise and vibration generated during the operation of the relay to minimize the transmission of the vibration to the PCB 10. In addition, when vibration occurs in the main body 100 in a lateral direction, the inclined extension portions 211, 221, 231, 241 and 251 may reduce the vibration while allowing the main body 100 to shake.

The plurality of terminals 210, 220, 230, 240, and 250 may be configured such that the inclined extension portions 211, 221, 231, 241, and 251 are different from each other in length and inclination and such that bent portions between the inclined extension portions 211, 221, 231, 241, and 251 and the coupling portions 212, 222, 232, 242, and 252 are different from each other in position. Accordingly, forces applied to the terminals 210, 220, 230, 240, and 250 become different, so that not only a lateral vibration acting on the main body 100 of the relay but also shock and vibration acting in a vertical direction may be stably reduced.

According to the relay of the present embodiment, the main body 100 may be stably supported because the base member 300 spaced apart from the main body 100 supports the coupling portions 212, 222, 232, 242, and 252 of the terminals 210, 220, 230, 240, and 250 in a state in which the base member 300 is in close contact with the surface of the PCB 10.

As is apparent from the above, a relay according to an embodiment can minimize transmission of noise and vibration generated during operation to the surroundings by mitigating the noise and vibration with a cushioning function of an inclined extension portion because the inclined extension portion included in each terminal extends on an incline from a main body to space the main body apart from a PCB.

According to the relay of an embodiment, the main body can be stably supported because a base member spaced apart from the main body supports a coupling portion of the terminal in a state in which the base member is in close contact with a surface of the PCB.

The invention claimed is:

1. A relay comprising:

a main body configured to open and close a circuit by an input signal;

a plurality of terminals extending from the main body and coupled to a PCB; and a base member coupled to a coupling portion of the plurality of terminals in a state of being spaced apart from the main body and installed in close contact with the surface of the PCB;

wherein each of the plurality of terminals comprises:

an inclined extension portion configured to allow the main body to be spaced apart from the PCB and to maintain an inclined state with respect to a surface of the PCB and a lower surface of the main body; and the coupling portion extending from the inclined extension portion in a direction to enter a coupling slot of the PCB.

2. The relay according to claim 1, wherein the plurality of terminals is configured such that a width of the inclined extension portion is wider than a width of the coupling portion and the coupling portion passes through the base member to be coupled to the coupling slot of the PCB.

3. The relay according to claim 2, wherein the plurality of terminals comprises a step portion formed at a boundary between the inclined extension portion and the coupling portion and caught on a surface of the base member in a state in which the coupling portion is coupled to the base member.

4. The relay according to claim 1, wherein the plurality of terminals is configured such that the inclined extension portions are different from each other in length and inclination.

5. The relay according to claim 1, wherein the plurality of terminals is configured such that bent portions between the inclined extension portions and the coupling portions are different from each other in position.

6. A relay comprising:

a main body configured to open and close a circuit by an input signal;

a plurality of terminals extending from the main body and coupled to a PCB;

wherein each of the plurality of terminals comprises:

an inclined extension portion configured to allow the main body to be spaced apart from the PCB and to maintain an inclined state with respect to a surface of the PCB and a lower surface of the main body; and a coupling portion extending from the inclined extension portion in a direction to enter a coupling slot of the PCB;

wherein the main body comprises:

an opening-and-closing driving unit including a pole core on which a coil is wound, a yoke configured to support the pole core, an armature configured to operatively supported on the yoke and to be attached to or spaced from the pole core, and a movable contact configured to be operated by the armature;

a fixed unit including a support plate configured to support the opening-and-closing driving unit, a contact support portion provided on one side of the support plate, and a fixed unit installed to the contact support portion such that the movable contact is in contact therewith or spaced apart therefrom; and a cover member configured to cover outer sides of the opening-and-closing driving unit and the fixed unit.

7. The relay according to claim 6, wherein the yoke is fixed to an upper surface of the support plate, the plurality of terminals extends toward the PCB through an outer side of the support plate in a state in which a portion thereof is connected to the opening-and-closing driving unit and the rest is connected to the fixed unit, and a distance between the coupling portions of the plurality of terminals is smaller than a width of the support plate.

* * * * *